United States Patent [19]

Kim

[11] Patent Number: 4,830,287

[45] Date of Patent: May 16, 1989

[54] PULVERIZED COAL FLOW CONTROL SYSTEM

[75] Inventor: Raymond K. Kim, Canton, Ohio

[73] Assignee: The Babcock & Wilcox Company, New Orleans, La.

[21] Appl. No.: 106,830

[22] Filed: Oct. 6, 1987

[51] Int. Cl.[4] ..... B02C 23/34

[52] U.S. Cl. ..... 241/19; 110/265; 241/24; 241/34; 241/48; 241/80; 241/119; 406/19; 406/193; 406/197

[58] Field of Search ..... 406/19, 20, 34, 193, 406/197; 110/263, 265, 222, 232, 229; 241/119, 80, 97, 48, 79.1, 33, 60, 61, 62, 18, 19, 24, 34

[56] References Cited

U.S. PATENT DOCUMENTS

| | | | |
|---|---|---|---|
| 1,092,302 | 4/1914 | Steckle | 241/48 |
| 4,226,371 | 10/1980 | Williams | 241/48 X |
| 4,498,633 | 2/1985 | Williams | 241/48 |

*Primary Examiner*—Mark Rosenbaum
*Attorney, Agent, or Firm*—Vytas R. Matas; Robert J. Edwards; Daniel S. Kalka

[57] ABSTRACT

An apparatus for supplying a controlled flow of pneumatically transported solid particles, in particular, pulverized coal, comprises a pulverizer or vessel for containing pneumatically suspended solid particles. A supply pipe is connected to the pulverizer or vessel for removing a mixture of pneumatic gas and solid particles from the vessel. A bend is provided in the supply pipe and an aspirator is connected to the supply pipe at a distance of from one to two pipe diameters from the bend. The aspirator is provided on the outer wall of the bend and is supplied with aspirating gas to draw off an amount of mixture from the supply pipe. This controls the amount of remaining flow of mixture through the pipe. The supply of the aspirator is connected to a bypass line which is connected to the mixture inlet of an injector which is supplied with injecting gas. The supply of the injector which carries the mixture is connected back into the vessel. The flow of aspirating and injecting gas is controlled on the basis of flow measurements taken on the supply pipe from the vessel. The aspirator and injector an accurately control the flow of pneumatically suspended solid particles.

14 Claims, 2 Drawing Sheets

PULVERIZED COAL FLOW CONTROL SYSTEM

FIELD AND BACKGROUND OF THE INVENTION

The present invention relates in general to pulverized coal supply arrangements, and in particular, to a new and useful flow control system for accurately controlling the mass flow rate of pneumatically transported pulverized coal.

In a pulverized coal burning boiler, one or more pulverizers are used to grind lumps of crushed coal into particulates with a certain desired sized distribution. The ariborne pulverized coal (PC) is transported to each burner in pipes ranging from 8 to 24 inches in diameter. There may be six or more pipes in parallel carrying PC to the burners. Boilers run at high efficiency when the burners are well balanced. Balanced burners require that both the primary air and the mass flow rate of PC are the same among all the pipes within certain operating limits. Each pipeline installed between the pulverizer and the burner generally has hydraulic resistance which is somewhat different from the other lines due to the difference in overall length of the line and the type and number of bends used between the two points. These variations in line resistance cause an imbalance of the primary air flow amoung the PC feed lines if not corrected.

A common industry practice is to add a fixed resistance orifice or pipe in the line that has a lower resistance than desired (FIG. 1). Then the primary air flow in each line is confirmed with a pitot tube in the absence of PC flow. However, the balanced primary air flow alone does not induce a balanced PC flow in the system due to the asymmetric flow distribution at the pulverizer outlet and the peculiarities in the airborne solids flow. Plant operators have reported an excess of 10% deviation in PC flow from the average in a system that had been balanced for the primary air flow using fixed resistance orifices and pipes.

While there are a number of PC flowmeters at various stages of development in the industry, there has not been any commercially available flow control system for P.C. transport lines. The primary reason for the absence of such a system is because it is very difficult to design a reliable control element that can meet a set of very tough operational requirements; namely:

1. For long-term, reliable service, the control element must be highly erosion-resistant if it is to be exposed to flowing coal particles.

2. The element must not appreciably increase the pressure drop of the line; the maximum tolerable increase in pressure drop would vary from plant to plant, but the permissible increase is very small in general;

3. The element should not interfere with the normal flow of the primary air which is required to keep the PC particles airborne;

4. Control should be sensitive enough to effect changes as small as 1–2% in PC mass flow rate; and 5. The element should be energy efficient and retrofittable to be commercially attractive and viable.

Some forms of metallic diverter vanes have been used at some plants on a trial basis. In general, they disrupt the air flow such that saltation is induced in the lines. The vanes are also very short-lived due to the erosion caused by the impinging coal particles flowing at high velocity. There is no other successful or unsuccessful system known, commercial or otherwise, that has been used to change the mass flow rate of PC that is pneumatically transported in a pipe.

SUMMARY OF THE INVENTION

The PC flow control system of the present invention includes an external air operated aspirator which is installed a short distance downstream of pipe bend, a length of small diameter bypass pipe, and an injector. The combination of aspirator/injector is arranged to reduce the PC mass flow rate in a line by a small fraction (usually less than 10%). The aspirator is located in the wall area of the pipe where the solids concentration is high so that mostly PC, with little air, is aspirated. The diverted PC is returned to the pulverizer just above the grinding wheel through the injector.

The internal PC passages in both the aspirator and the injector should be lined with a wear-resistance ceramic material such as Ceravam, whose performance has already been proven in many operating plants. The aspirated PC flow rates will be increased or decreased by controlling the pressure of the compressed air applied to the aspirator and the injector. Flow monitoring, calculation of the flow imbalance, and the magnitude of the required correction can be continuously coordinated by a central flow computer.

A number of potential problems are solved with the inventive system.

1. No part of the control system is exposed to PC flow except a flared aspirator intake nozzle which is ceramic-lined for erosion resistance and long service life.

2. The system will not increase the pressure drop in the PC feed lines since no resistance is added.

3. The system does not interfere with the normal primary air flow since no hardware is placed in the flow stream.

4. The control is sufficiently sensitive to effect small changes in PC flow rate. The PC bypass flow rate can be steplessly adjusted by regulating the operating pressures for the aspirator and the injector.

5. The system can be readily retrofitted to existing power plants and can also be integrated as a part of any new boiler control system. The system is expected to be efficient partly because the compressed air used to operate the aspirator and the injector is exhausted into the primary air flow stream and performs a useful function.

6. Operation of the system does not depend on any mechanical moving part or linkage, making the system inherently reliable for long-term, trouble-free service.

While the present invention is particularly suited for supplying a controlled flow of pulverized coal to a pulverized coal-fired burner, the invention can be utilized to control the flow of any pneumatically transported solid particles.

Accordingly, an object of the present invention is to provide an apparatus for supplying a controlled flow of pneumatically transported solid particles, comprising: a vessel for containing a mixture of pneumatically suspended solid particles and pneumatic fluid; a supply pipe connected to the vessel for supplying the mixture from the vessel; an aspirator having a mixture inlet connected to the supply pipe, an aspirating gas inlet for a supply of aspirating gas for drawing mixture from the supply pipe into the aspirator, and a mixture outlet; an injector having a mixture inlet, an injecting gas inlet for receiving a supply of injecting gas for drawing mixture into the injector through the mixture inlet of the injector, and a mixture outlet connected to the vessel for returning mixture to the vessel; a bypass line connected between the mixture outlet of the aspirator and the mixture inlet of the injector for returning mixture from the aspirator to the injector; and gas supply means for supplying a controlled amount of aspirating gas to the aspirator and a controlled amount of injecting gas to the injector for controlling the flow of mixture through the supply pipe past the aspirator.

Another object of the present invention is to provide a method of supplying a controlled flow of pneumtically transported solid particles, comprising: suspending solid particles in a vessel to form a mixture of solid particles and pneumatic gas; discharging the mixture through a supply pipe out of the vessel; aspirating a controlled amount of mixture from the supply line to leave a remaining controlled flow of pneumatically transported solid particles to be supplied by the supply pipe; injecting the controlled amount or mixture which was aspirated from the supply pipe back into the vessel; and controlling a flow of aspirating gas and injecting gas for aspirating the controlled amount of mixture from the supply pipe and injecting the controlled amount of mixture into the vessel, to control the remaining flow of pneumatically transported solid particles in the supply pipe.

A still further object of the invention is to provide an apparatus for supplying a controlled flow of pneumatically suspended particles which is simple in design, rugged in construction and economical to manufacture.

BRIEF DESCRIPTION OF THE-DRAWINGS

In the accompanying drawings, forming a part of this specification, and in which reference numerals shown in the drawings designate like or corresponding parts throughout same:

DESCRIPTION OF THE PREFERRED EMBODIMENT

Figure 1:
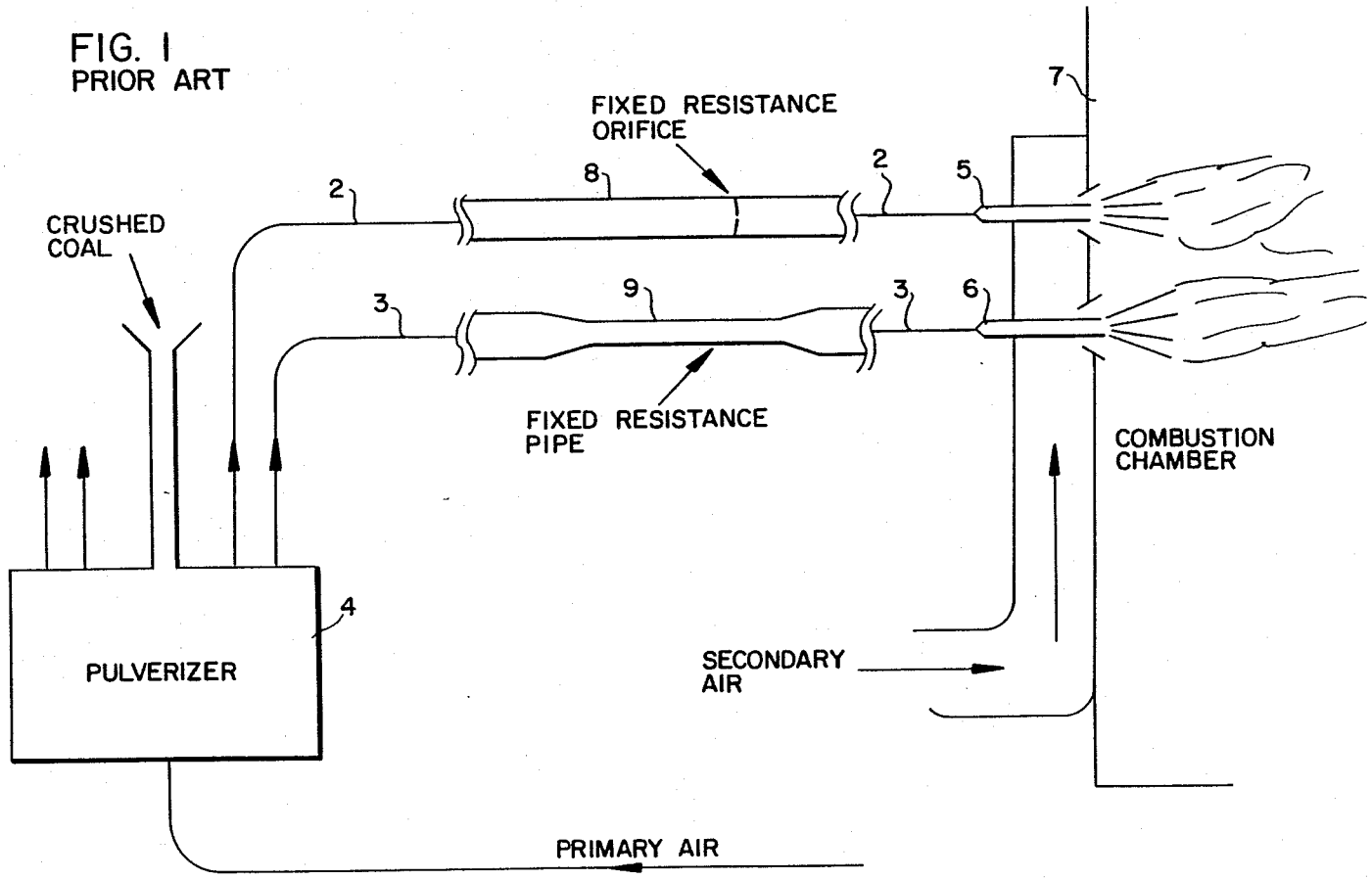
FIG. 1 PRIOR ART
FIG. 1 is a schematic representation of apparatus for supplying pulverized coal to the burners of a combustion chamber utilizing a fixed resistance orifice and pipe for balancing primary air flow for the suspended pulverized coal being supplied to the burners.

Referring to the drawings, in particular, FIG. 1 illustrates the prior art approach for balancing the mass flow rate of pneumatically suspended pulverized coal being supplied over a plurality of supply pipes 2 and 3 from a pulverizer 4 to burners 5 and 6 of a combustion chamber 7. To this end, fixed resistance orifice pipe 8 is provided in supply pipe 2 and fixed resistance pipe 9 is provided in supply pipe 3. The use of these fixed resistances results in imbalances of 10% or more. It is estimated that even a one half percent increase in efficiency for controlling the mass flow rate of pulverized coal being supplied to coal burning boilers in a 500 megawatt plant, can save approximately $400,000 per year in fuel costs. According to the present invention, a more responsive and efficient control for PC flow rate is possible which will not only yield savings in cost, but also produce a well balanced feed system which can more closely control stack emissions.

The system of the present invention has the two essential elements which are needed for balancing PC flow. These are a mechanism for measuring PC flow rate in each pipe and a means to increase or decrease the PC flow rate in each pipe and a means to increase or decrease the PC flow rate to a desired level in each pipe.

Figure 2:
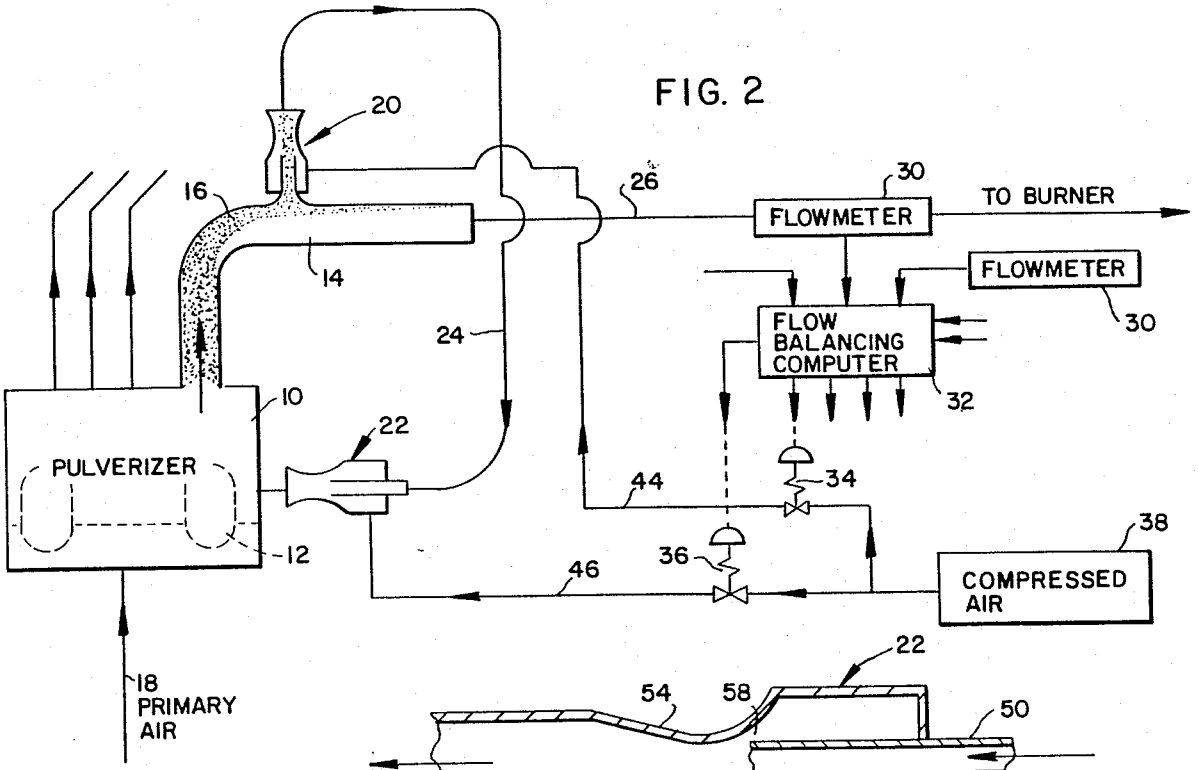
FIG. 2 is a schematic representation of an apparatus for supplying a controlled flow of pneumatically transported pulverized coal in accordance with the present invention.

As shown in FIG. 2 the present invention is provided in combination with a pulverizer 10 having grinding wheels 12 therein, for grinding coal supplied into the pulverizer. Primary air 18 is supplied to the vessel of pulverizer 10 for pneumatically suspending solid particles of the pulverized coal in the vessel. These solid particles are conveyed out of the vessel through an outlet pipe 14 having a 60°–90° bend 16 therein. Outlet pipe 14 is connected to a supply pipe 26 which ultimately reaches the burner of a furnace or boiler. A flow meter 30 is provided in supply line 26 for measuring flow and for providing a signal corresponding to the PC flow to a flow balancing computer 32.

An aspirator generally designated 20 has a mixture inlet flanged to the outlet pipe 14, for receiving a mixture of particles and pneumatic gas from the outlet pipe 14. This mixture is drawn off by an aspirating gas provided to an aspirating gas inlet of aspirator 20 over an aspirating gas line 44.

An injector generally designated 22 which can be substantially the same as the aspirator 20, has an inlet for a particle plus pneumatic gas mixture which is connected to a bypass line 24. Bypass line 24 is connected to the mixture outlet of aspirator 20 for returning the mixture of particles and pneumtic gas to the pulverizer. To this end, the mixture outlet of injector 22 is connected to the pulverizer vessel at a location immediately above the grinding wheels 12. Injector 22 is provided with an injection gas inlet which is connected to an injector supply line 46.

For the efficient and advantageous operation of the present invention, the mixture inlet of aspirator 20 is provided at a position of 1 to 2 pipe diameters downstream of bend 16, and on the outer wall of the bend. The concentration of particles is higher along the outer wall of the pipe bend due to the redistribution effect induced by the centrifugal force imparted to the coal particles as they flow around the bend. This particle concentration on the outer wall persists several pipe diameters along the bend. To resist erosion and wear due to the highly abrasive high velocity PC particles, the aspirator 20 and injector 22 are lined with ceramic material.

The injector 22 is connected to the pulverizer vessel at a location immediately above the grinding wheels 12 since the region from the bottom of the pulverizer through the grinding wheel constitutes a major hydraulic resistance in the primary air flow system. The injection point is chosen so that any increase of pressure drop in the primary air supply system is avoided.

The PC bypass line 24 connected between the aspirator and the injector is preferably a length of pipe having a diameter of approximately 3" for most installations. The pipe should be sloped down from the aspirator to the injector to take advantage of gravity feed for the PC particles.

The flow meter 30 and computer 32 are part of existing plant flow monitoring apparatus.

Additional gas control valves 34 and 36 are provided respectively in the aspirating supply line 44 and injecting gas supply line 46, for controlling the flows of these gases. The flow of aspiration and injection gas is controlled to adjust the flow as measured on flow meter 30, to the desired level. If, for example, more aspirating and injecting gas is provided over lines 44 and 46, a larger amount of PC will be removed from outlet pipe 14, reducing the mass flow rate of PC on supply line 26. Conversely, if the aspiration and injection gas amounts are reduced (by slightly closing valves 34 and 36), less PC is removed from outlet pipe 14, thus increasing the mass flow rate of PC on supply line 26.

Tests using a laboratory model of the invention have shown its effectiveness to accurately and efficiently control the flow of pneumatically suspended solid particles. For these tests, a model 901B and Transvector Jet was utilized as the aspirator and as the injector. In a full scale working example of the present invention, it is anticipated that larger aspirators and injectors will be utilized.

Although the present invention was conceived primarily to solve the problems associated with the control of airborne coal particles fed to boiler plants, the present invention has wider applications including any pneumatic transport system for carrying solid particles. Generally, any system that has similar operating requirements as those of the PC feed lines could take advantage of the present invention. Specifically, where the flowing media is highly erosive, the system cannot tolerate appreciable increase in pressure drop, and a long-term reliable service is required. Many processes in the petrochemical, food processing and pharmaceutical industries transport solid particles and powder pneumatically. The flow rate of the solids must be controlled on line. Potential applications exist in such situations which may be even more advantageous than for controlling the flow of PC.

The invention claimed is:

1. An apparatus for supplying a controlled flow of pneumatically transported solid particles, comprising: a vessel for containing a mixture of pneumatically suspended solid particles and pneumtic fluid; a supply pipe connected to the vessel for supplying the mixture from the vessel; an aspirator having a mixture inlet connected to the supply pipe, an aspirating gas inlet for a supply of aspirating gas for drawing mixture from the supply pipe into the aspirator, and a mixture outlet; an injector having a mixture inlet, an injecting gas inlet for receiving a supply of injecting gas for drawing mixture into the injector through the mixture inlet of the injecture, and a mixture outlet connected to the vessel for returning mixture to the vessel; a bypass line connected between the mixture outlet of the aspirator and the mixture inlet of the injector for returning mixture from the aspirator to the injector; and gas supply means for supplying a controlled amount of aspirating gas to the aspirator and a controlled amount of injecting gas to the injector for controlling the flow of mixture through the supply pipe past the aspirator.

2. An apparatus according to claim 1 wherein the supply pipe includes a bend at a location spaced from the vessel, the bend having an outer wall, the aspirator mixture inlet being connected near the outer wall of the bend downstream of the bend in the supply pipe.

3. An apparatus according to claim 2 wherein the aspirator mixture inlet is spaced from the bend by one to two times the diameter of the supply pipe.

4. An apparatus according to claim 1 wherein the mixture outlet of the aspirator is positioned above the mixture inlet of the injector, the bypass line sloping downwardly from the aspirator to the injector.

5. An apparatus according to claim 1 wherein the aspirator and injector are lined with wear resistant ceramic.

6. An apparatus according to claim 1 wherein the vessel comprises a pulverizer having at least one grinding wheel therein, the mixture outlet of the injector being connected to the pulverizer above the grinding wheel.

7. An apparatus according to claim 1 wherein the gas supply means comprises an aspirating gas supply line connected to the aspirating gas inlet of the aspirator, and an injecting gas supply line connected to the injecting gas inlet of the injector, said said supply means further including a control valve in each of the gas supply lines for controlling the flow of aspirating and injecting gas to the respective aspirator and injector.

8. An apparatus according to claim 7 including a flow meter in the supply pipe for pneumatically suspended solid particles, and computing means connected between the flow meter and the control valves for controlling the valves in accordance with a flow measured by the flow meter for increasing and decreasing the flow of pneumatically suspended solid particles in the supply pipe.

9. A method of supplying a controlled flow of pneumatically transported solid particles, comprising:

suspending solid particles in a vessel to form a mixture of solid particles and pneumatic gas;

discharging the mixture through a supply pipe out of the vessel;

aspirating a controlled amount of mixture from the supply pipe to leave a remaining control led flow of pneumtically transported solid particles of be supplied by the supply pipe;

injecting the controlled amount of mixture which was aspirated from the supply pipe, back into the vessel;

and controlling a flow of aspirating gas and injecting gas for aspirating the controlled amount of mixture from the supply pipe and injecting the controlled amount of mixture into the vessel, to control the remaining flow of pneumtically transported solid particles in the supply pipe.

10. A method according to claim 9 wherein the vessel is a pulverizer having at least one grinding wheel, and including injecting the mixture into the pulverizer above the grinding wheel.

11. A method according to claim 10 including measuring the flow of mixture in the supply pipe downstream of the location where mixture is aspirated from the supply pipe, and controlling the flow of aspirating and injecting gas for controlling the flow of mixture in the supply pipe.

12. A method according to claim 11 including aspirating mixture from the supply pipe downstream of a bend in the supply pipe and on an outside wall of the bend.

13. A method according to claim 12 including aspirating mixture from the supply pipe at a location above the location where mixture is injected into the pulverizer.

14. A method according to claim 13 including aspirating mixture from the supply pipe through an aspirator which is lined with ceramic, and injecting mixture into the pulverizer through an injector which is lined with wear resistant ceramic.

* * * * *

UNITED STATES PATENT AND TRADEMARK OFFICE

CERTIFICATE OF CORRECTION

PATENT NO. : 4,830,287

DATED : May 16, 1989

INVENTOR(S) : Kim

It is certified that error appears in the above-identified patent and that said Letters Patent is hereby corrected as shown below:

In the drawings

Figure 3:
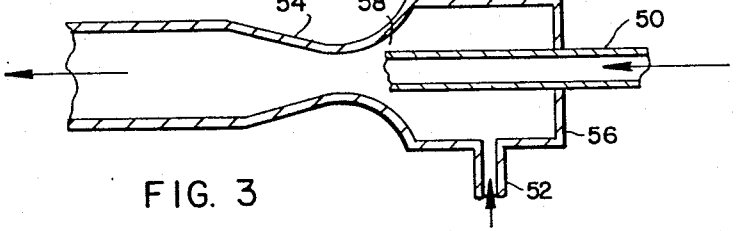

Fig. 3 of the drawings should be deleted.

Signed and Sealed this

Fourteenth Day of January, 1992

*Attest:*

HARRY F. MANBECK, JR.

*Attesting Officer*

*Commissioner of Patents and Trademarks*